US007975333B2

(12) United States Patent
Guguin et al.

(10) Patent No.: US 7,975,333 B2
(45) Date of Patent: Jul. 12, 2011

(54) BED WITH INTERCONNECTABLE BARRIER ELEMENTS

(75) Inventors: Pascal Guguin, Brech (FR); Pascal Lemonnier, Locoal Mendon (FR); Frederic Bregeon, St Ave (FR)

(73) Assignee: Hill-Rom Services, Inc.

( * ) Notice: Subject to any disclaimer, the term of this patent is extended or adjusted under 35 U.S.C. 154(b) by 150 days.

(21) Appl. No.: 12/535,904

(22) Filed: Aug. 5, 2009

(65) Prior Publication Data

US 2010/0031442 A1 Feb. 11, 2010

(30) Foreign Application Priority Data

Aug. 5, 2008 (FR) ..... 08 55419

(51) Int. Cl.
*A47C 21/08* (2006.01)

(52) U.S. Cl. ..... 5/430; 5/425; 5/428

(58) Field of Classification Search ..... 5/424–430, 5/503.1, 658, 662
See application file for complete search history.

(56) References Cited

U.S. PATENT DOCUMENTS

| | | | | |
|---|---|---|---|---|
| 5,381,571 | A * | 1/1995 | Gabhart | 5/430 |
| 5,485,699 | A * | 1/1996 | Gabhart | 49/394 |
| 6,401,277 | B1 * | 6/2002 | Savage et al. | 5/430 |
| 2005/0108825 | A1 | 5/2005 | Tayoun, Jr. | |
| 2006/0021142 | A1 | 2/2006 | Hornbach | |
| 2010/0031441 | A1 * | 2/2010 | Guguin et al. | 5/430 |
| 2010/0031442 | A1 * | 2/2010 | Guguin et al. | 5/430 |

FOREIGN PATENT DOCUMENTS

| | | | |
|---|---|---|---|
| DE | 20 2006 015095 | U1 | 11/2006 |
| WO | 2002096340 | A1 | 12/2002 |

OTHER PUBLICATIONS

French Search Report, "Application No. FR 0855419", (Mar. 9, 2009).
European Search Report, "Application No. EP 09251931", (Oct. 6, 2009), The Hague.

* cited by examiner

*Primary Examiner* — Robert G Santos
(74) *Attorney, Agent, or Firm* — Kenneth C. Baran

(57) ABSTRACT

A bed has two safety barrier elements arranged along a common side. Each barrier element (19, 21) is linked to the bed frame (11) by two hinged arms (25, 26; 35, 36) forming a deformable parallelogram mechanism, but only one (19) comprises means of locking in the up position (49), whereas attachment means (45, 46) are installed between the adjacent ends of the two barrier elements for selectively constituting a barrier consisting of a single piece.

11 Claims, 4 Drawing Sheets

BED WITH INTERCONNECTABLE BARRIER ELEMENTS

This application claims priority under 35 USC §119 to French application (serial number 08 55419) filed on Aug. 5, 2008.

TECHNICAL FIELD

The invention relates to a patient bed equipped with two lateral safety barriers (also known as half barriers or barrier elements) arranged along a common lengthwise side of said bed. The invention more particularly relates to an improvement enabling a coupling of the two barrier elements, in order to make such a system easier to use and more functional.

BACKGROUND

A patient bed equipped with two lateral barriers, namely a head lateral barrier element and a foot lateral barrier element, arranged on a common lengthwise side of its frame is known to the prior art. When the two barrier elements are in the upright position, they adjoin one along the extension of the other and prevent the patient from falling. However, they are independently moveable relative to each other so that an exit space can be opened, enabling the patient to get up under his or her own power if his or her condition permits it. Typically, the head barrier element is left in the raised position and the foot barrier element is lowered. The patient can then sit on the edge of the bed and stand up, using at least the head barrier element for support.

The independence of the two barrier elements, however, multiplies the manipulations for the medical staff in comparison with the simplicity of a system comprising only one long barrier. The factory price is also increased because a mechanism for locking in the up position must be provided for each barrier element.

SUMMARY

The invention proposes a two barrier element system enabling the patient to get out of the bed but nonetheless having the same advantages of simplicity of design and use as a single long barrier.

The fundamental idea of the invention consists of provision of a two barrier element system in which only one barrier element is equipped with a mechanism for locking in the up position relative to the bed. The other barrier element is capable of pivoting freely but hooks and locks with the barrier element equipped with a locking mechanism relative to the bed.

The invention relates more particularly to a patient bed comprising a bed frame and two lateral safety barrier elements arranged along a common lengthwise side of said frame, namely a head barrier element and a foot barrier element, wherein each barrier element is linked to the bed frame by two hinged arms forming a deformable parallelogram mechanism, characterized in that only one of the barrier elements comprises means for locking in the up position and further characterized in that between adjacent ends of the two barrier elements are installed connection means for selectively joining them one in the extension of the other so as to constitute a barrier consisting of a single piece and capable of being manipulated as such.

Preference is given to the head barrier element being the barrier element comprising the means of locking in the up position.

According to another advantageous characteristic, at least one of the barrier elements comprises a laterally tiltable part pivot—mounted about a lower horizontal axis of said main frame.

The invention will be more easily understood and its other advantages will emerge more clearly from the following description of a patient bed conforming to the principle of the invention, which is provided solely for illustrative purposes and which refers to the appended drawings, in which.

DETAILED DESCRIPTION

The patient bed illustrated consists of a bed frame 11 equipped with a rectangular support frame 13 on which resides a mattress (not shown). The bed frame 11 is equipped with a headboard 15 and a footboard 17, which extend crosswise.

Figure 1:
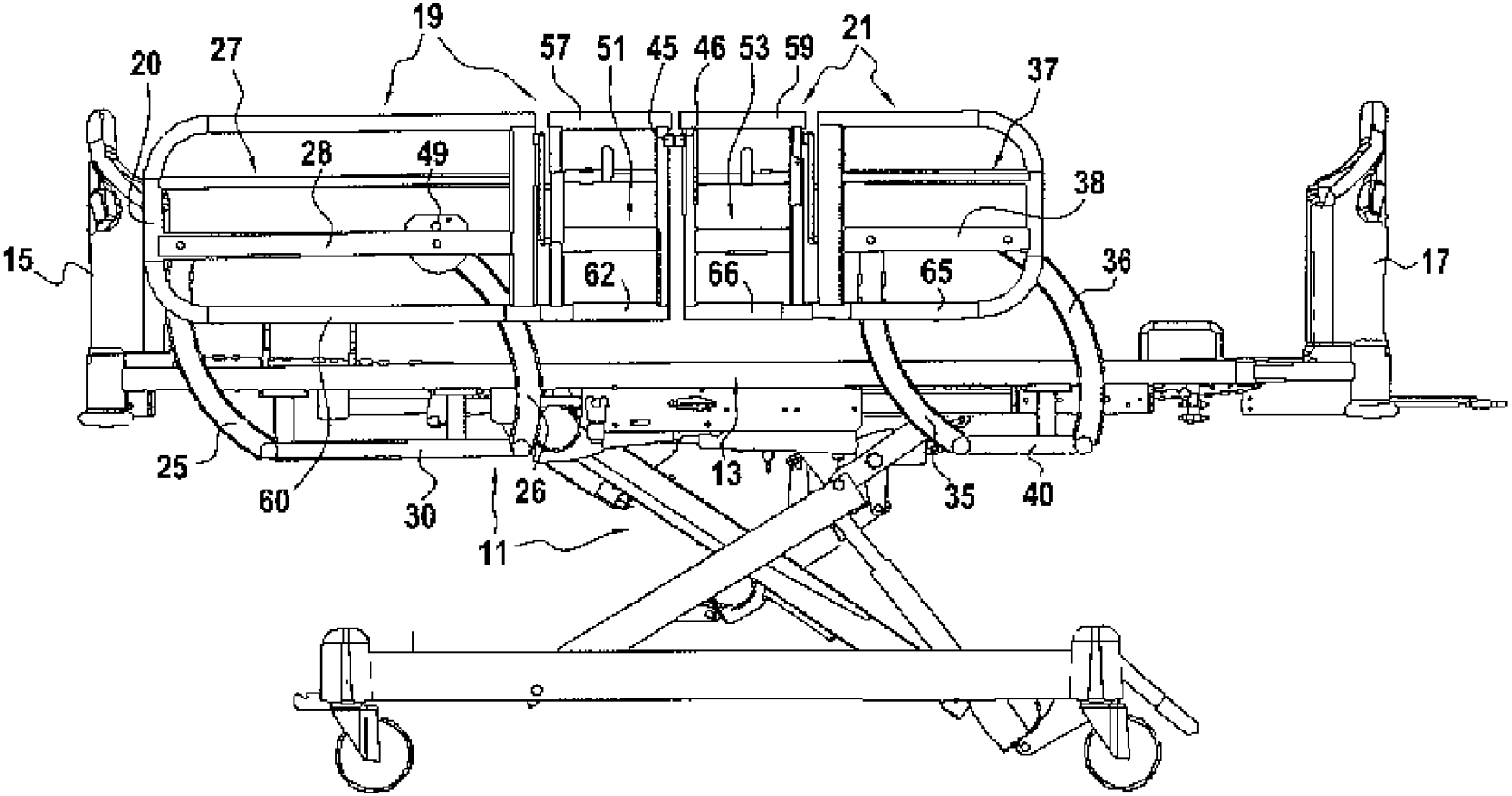
FIG. 1 is an elevation of a patient bed of the invention, with the two lateral barrier elements in the raised position.

At least one of the lengthwise sides of the bed frame is equipped with two lateral barriers 19, 21. One of these is a head barrier element 19, one end 20 of which is adjacent to the head of the bed when it is in the raised position as shown in FIG. 1, and the other is a foot barrier element 21, which adjoins and extends the head barrier element in the raised position.

Each barrier element 19, 21 is displaceable between an up position and a down position by translation-rotation in its own plane by means of a deformable parallelogram mechanism.

More precisely, the head barrier element 19 is linked to the bed frame 11 by two hinged arms 25, 26. The barrier element consists of a main frame 27 equipped with a horizontal cross member 28 to which the two upper ends of the two arms 25, 26 are hinged. The lower ends of said arms are hinged to a cross member 30 of the bed frame disposed below the rectangular support frame 13.

Figure 2:
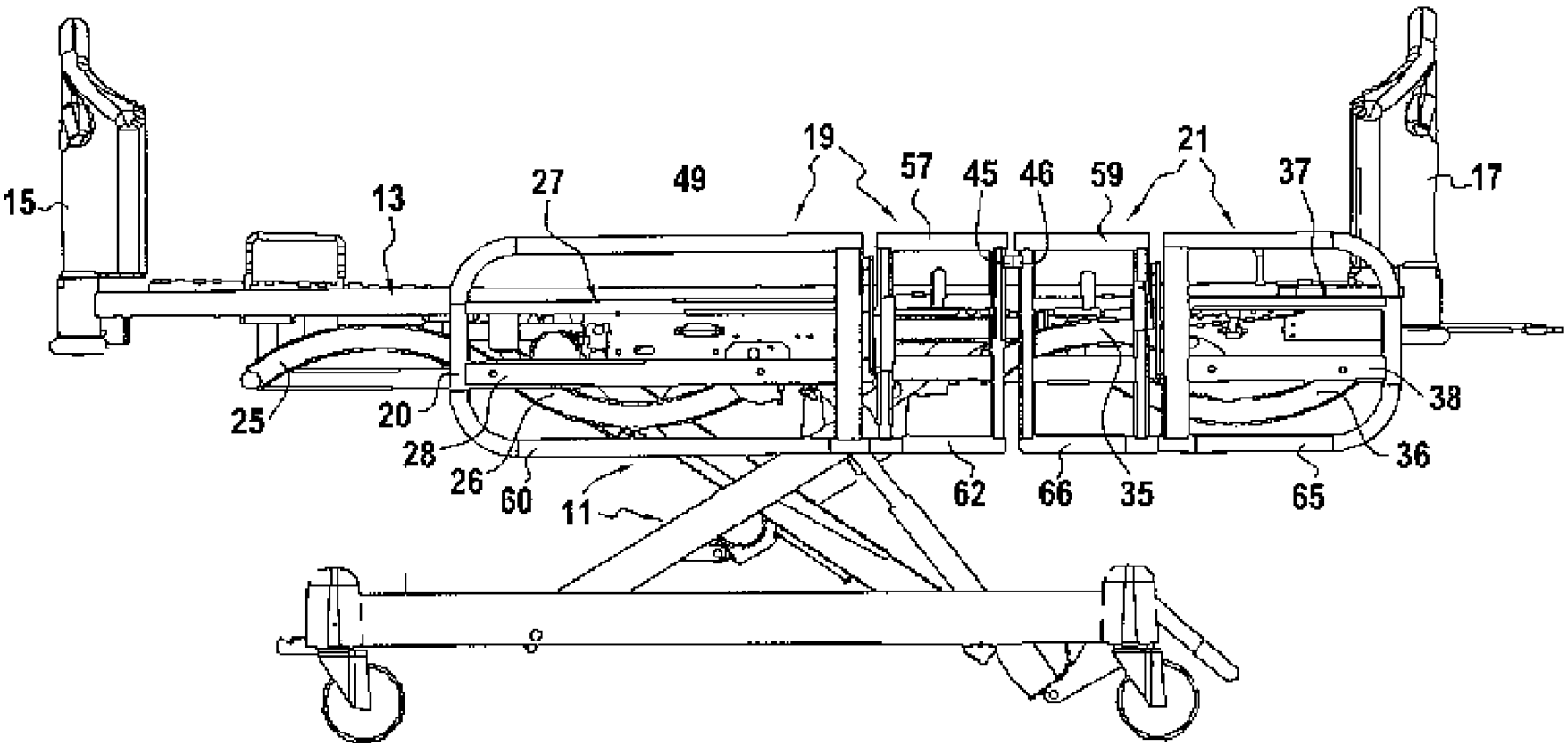
FIG. 2 is a view analogous to that of FIG. 1, with the two lateral barrier elements in the lowered position.
Figure 3:
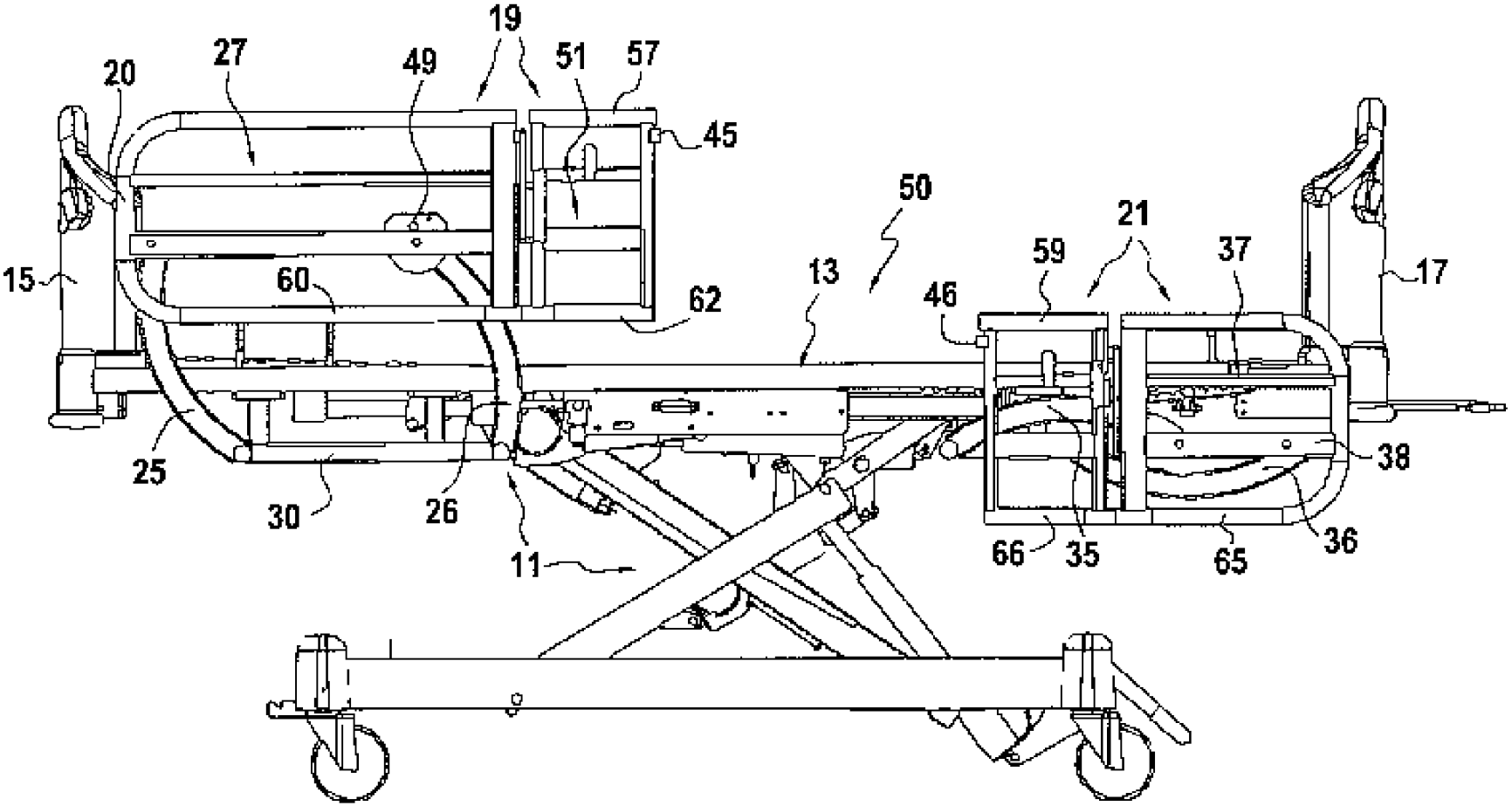
FIG. 3 is an analogous view in which the head barrier element is raised and the foot barrier element is lowered.

In an analogous manner, the foot barrier element 21 is linked to the bed frame by two hinged arms 35, 36. It consists of a main frame 37 equipped with a horizontal cross member 38 to which the two upper ends of the two arms 35, 36 are hinged. The lower ends of said arms are hinged to a cross member 40 of the bed frame disposed below the rectangular support frame 13. Typically, the barrier elements can be moved to the up position (FIG. 1) for complete protection of the patient. Both of them can also be moved to the retracted, down position (FIG. 2) in order to care for the patient, or to move a gurney next to the bed for transferring the patient.

According to an essential characteristic of the invention, only one of the barrier elements, in this case the head barrier element 19, comprises means for locking in the up position. The foot barrier element 21 is freely displaceable in a movement imposed by the two arms 35, 36.

In addition, connection and hooking means 45, 46 are installed between the adjacent ends of the two barrier elements 19, 21 in order to selectively join them one in the extension of the other in order to constitute a barrier consisting of a single piece. With the two barrier elements thus joined together, the long barrier that they constitute can be manipulated as if it were structurally a single piece.

In the example shown, the means for locking the head barrier element in the up position consist of a retractable stop mechanism 49 and the corresponding main frame 27, wherein said stop mechanism is arranged between said main frame and one of the aforesaid arms.

Figure 4:
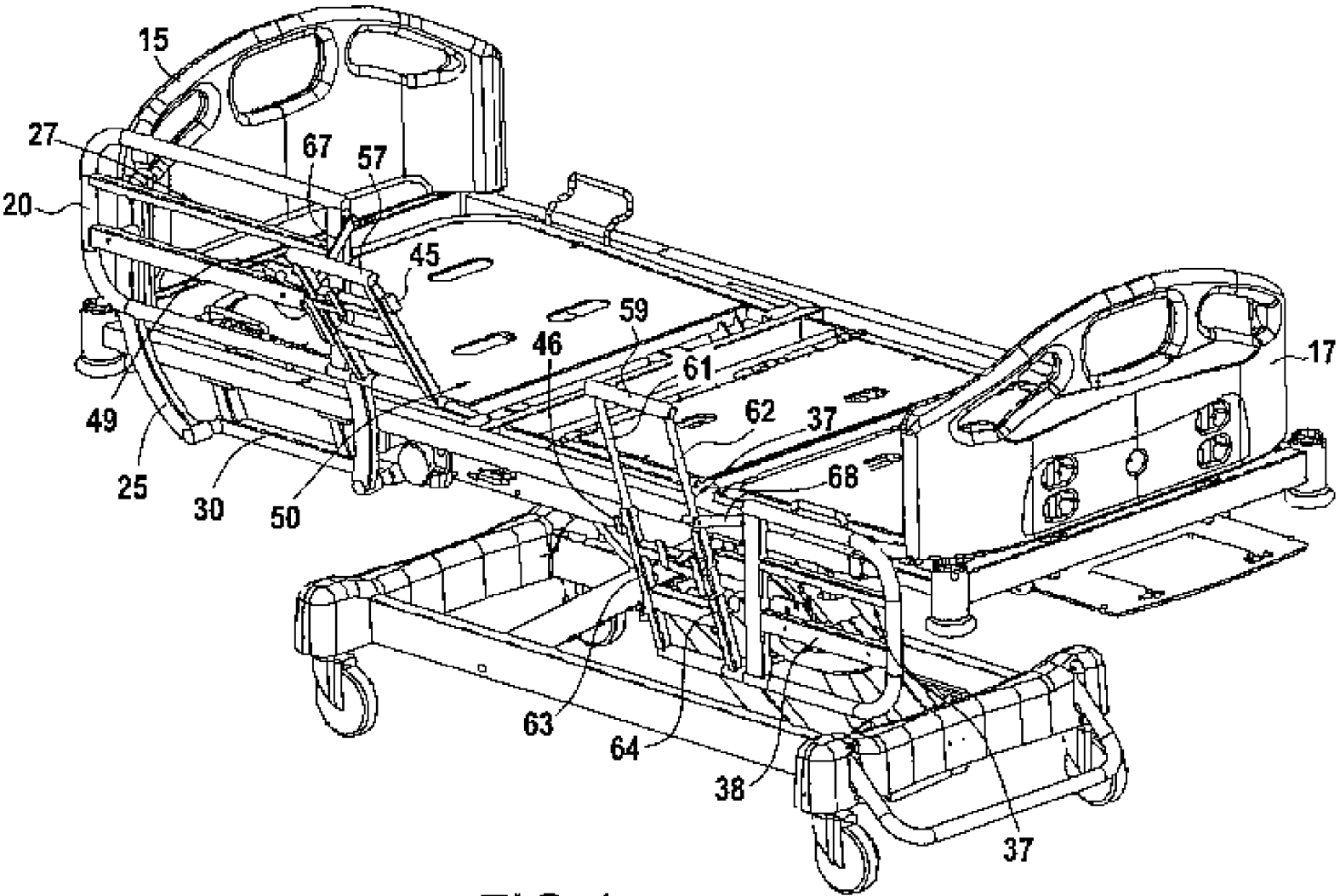
FIG. 4 is a perspective view of the bed, with the barrier elements in the same positions as in FIG. 3, but with their tiltable parts outwardly deployed to facilitate the patient's getting out of the bed.

Furthermore, according to the example, each barrier element 19, 21 comprises a laterally tiltable part 51, 53 pivot-mounted about a lower horizontal axis of the corresponding main frame 27, 37. When they are separated from each other, and more particularly by the foot barrier element being closest to the footboard, an exit space is opened, allowing the patient to get out of the bed under his or her own power by sitting on the edge of the bed and then standing up. During this phase, the barrier elements 19, 21 (or at least the head barrier element 19) serve as hand holds for the patient. When at least one such barrier is in the up position but with its tiltable part outwardly deployed as shown in FIG. 4, the patient has a secure and comfortable hand hold for standing up. The lateral offset of the support point improves the patient's balance while moving from the sitting position to the standing position. This deployment of the tiltable parts 51, 53 outwardly displaces the support points in front of the patient. The projection of the center of gravity of the patient's body thus remains within a polygon of support delimited by the feet and the projection of the support point or points to the floor.

The upper horizontal bar 57, 59 of each tiltable part constitutes a handhold for the patient. As for the foot barrier element, the upper horizontal bar 59 is fastened to two parallel rods 61, 62 capable of sliding in two parallel tubular uprights 63, 64, respectively, of the tiltable part 37. In this manner, the upper horizontal bar 59 of the tiltable part of the foot barrier element 21 can be aligned roughly at the same level as the upper horizontal bar 57 of the tiltable part of the head barrier element 19 even when the foot barrier element is lowered. In this case, the exit space 50 is opened between the two barrier elements, roughly in the center of the bed, and the patient has two tilted handhold elements to use for standing up.

Given that the two tiltable parts 51, 53 are adjacent when the two barrier elements 19, 21 are hooked together, said connection and hooking means 45, 46 allowing the subjugation of the foot barrier element to the displacement of the head barrier element are arranged between the two adjacent ends of these two tiltable parts. When the two barrier elements are raised, the two tiltable parts are realigned one in the extension of the other and in the same plane as the main frames of said barrier elements.

The main frame 27 of the head barrier element consists of a horizontal tubular element 60 which forms the pivot axis of the tiltable part 51, a lower side 62 of which comprises an extension rotatably engaged and mounted in the tubular element 60. The latter forms a type of support bearing for the tiltable part. In an analogous manner, the main frame 37 of the foot barrier element consists of a horizontal tubular element 65 which forms the pivot axis of the tiltable part 53. A lower side 66 of the latter comprises an extension rotatably engaged and mounted in the tubular element 65.

The deployed position of each tiltable part is stabilized by any suitable blocking means, say, by a connecting shaft or rod 67, 68 mounted between the edge of the main frame 27, 37 and the adjacent edge of the tiltable part 51, 53, respectively.

We claim:

1. A bed comprising a bed frame a head barrier element and a foot barrier element each extending longitudinally in series along a common lateral side of the bed frame, each barrier element being linked to the bed frame by two hinged arms forming a deformable parallelogram mechanism, one and only one of the barrier elements being lockable in an up position, and a connection between adjacent ends of the two barrier elements in order to join them selectively, one in extension of the other, so as to constitute a barrier consisting of a single piece and capable of being manipulated as such.

2. The bed of claim 1 wherein the barrier element lockable in the up position is the head barrier element.

3. The bed of claim 1 or 2, wherein at least one barrier element comprises:

a main frame to which are hinged the two arms and wherein these two arms are themselves hinged to the bed frame in order to form the deformable parallelogram mechanism; and a laterally tiltable part pivot-mounted about a lower horizontal axis of the main frame.

4. The bed of claim 3 wherein a retractable stop mechanism of the main frame arranged between the main frame and one of the aforementioned arms renders the one and only one barrier element lockable in the up position.

5. The bed of claim 3, wherein each barrier element comprises a main frame and a laterally tiltable part, wherein the two tiltable parts are adjacent when the two barrier elements are joined together.

6. The bed of claim 5 wherein the connection extends longitudinally between the two adjacent ends of the two tiltable parts.

7. The bed of claim 3 wherein an upper horizontal bar of at least one of the tiltable parts constitutes a handhold.

8. The bed of claim 7, wherein the upper horizontal bar is fastened to two parallel rods capable of sliding in two parallel tubular uprights, respectively, of the tiltable part.

9. The bed of claim 1 wherein the connection extends longitudinally between the two adjacent ends of the two barrier elements.

10. The bed of claim 9 wherein an upper horizontal bar of at least one of the tiltable parts constitutes a handhold.

11. The bed of claim 10, wherein the upper horizontal bar is fastened to two parallel rods capable of sliding in two parallel tubular uprights, respectively, of the tiltable part.

* * * * *